United States Patent [19]

Sumi

[11] Patent Number: 4,898,376

[45] Date of Patent: Feb. 6, 1990

[54] FILM CONVEYING APPARATUS

[75] Inventor: Sigeo Sumi, Saitama, Japan

[73] Assignee: Somar Corporation, Tokyo, Japan

[21] Appl. No.: 231,631

[22] Filed: Aug. 11, 1988

Related U.S. Application Data

[62] Division of Ser. No. 11,470, Feb. 5, 1987, abandoned.

[30] Foreign Application Priority Data

Feb. 5, 1986 [JP] Japan ..... 61-23177

[51] Int. Cl.[4] ..... B65H 5/02

[52] U.S. Cl. ..... 271/272; 156/344; 156/584

[58] Field of Search ..... 271/272; 156/344, 584

[56] References Cited

U.S. PATENT DOCUMENTS

| | | | |
|---|---|---|---|
| 2,719,714 | 10/1955 | Pratt et al. | 271/272 |
| 4,106,767 | 8/1978 | Schirrmeister et al. | 271/272 X |
| 4,724,032 | 2/1988 | Kay | 156/344 |

FOREIGN PATENT DOCUMENTS

| | | | |
|---|---|---|---|
| 3339723 | 3/1985 | Fed. Rep. of Germany . | |
| 2127382 | 4/1984 | United Kingdom | 271/272 |
| 2181094 | 4/1987 | United Kingdom . | |

OTHER PUBLICATIONS

"Patent Abstracts of Japan", vol. 9, No. 67, 3/27/85-Abstract of JPA 59-198244.

*Primary Examiner*—F. J. Bartuska
*Assistant Examiner*—David H. Bollinger
*Attorney, Agent, or Firm*—Sughrue, Mion, Zinn, Macpeak & Seas

[57] ABSTRACT

A film conveying apparatus comprises first conveyor belts for conveying a film by contacting with one side of the film and a second conveyor belt for conveying the film by contracting with the other side of the film, plurality of the first conveyor belts being arranged with fixed intervals in a crosswise direction of the film being conveyed crossing the conveyance direction, the second conveyor belt being disposed between the first conveyor belts.

8 Claims, 8 Drawing Sheets

FILM CONVEYING APPARATUS

This is a Division of application Ser. No. 07/011,470, filed 2/5/87, now abandoned.

BACKGROUND OF THE INVENTION

This invention relates to a film conveying technique, and more particularly to a technique which can be effectively employed to convey a protective film peeled from the substrate or panel.

In a printed circuit board used in an electronic device such as a computer, a predetermined circuit is formed with copper on one or both sides of an insulated substrate or panel.

A printed circuit board of this type can be manufactured as follows: First, a laminate consisting of a photosensitive resin (photo-resist) layer and a translucent resin film (protective film) for protecting the photosensitive resin layer is thermally formed on the conductive layer of the insulated substrate under pressure. Thereafter, a circuit pattern film is laid over the laminate thus formed, and the photosensitive resin layer is exposed to light through the circuit pattern film and the translucent resin film for a predetermined period of time. After the translucent resin film is peeled off, the photosensitive resin layer thus exposed to light is subjected to developing to form an etching mask pattern. Thereafter, the unnecessary parts of the conductive layer are removed by etching, to obtain a printed circuit board having the predetermined circuit pattern.

In the above-described printed circuit board manufacturing method, in developing the photosensitive resin layer it is necessary to peel the translucent resin film off.

An object of the present invention is to obtain a film conveyance apparatus which can efficiently and accurately convey the thin film peeled off.

The above-described object and other objects of the invention and novel features of the invention will become more apparent when read the following description in conjunction with the accompanying drawings.

SUMMARY OF THE INVENTION

In order to achieve the above object, according to the present invention, a film conveyance apparatus comprises a first conveyor belt and a second conveyor belt for conveying a film, the first conveyor belt conveying the film by contacting with one side of the film, the second conveyor belt conveying the film by contacting with the other side of the film, a plurality of the first conveyor belts being arranged with predetermined intervals in a direction transverse to the direction in which the film is being conveyed, the second conveyor belt being arranged between the first conveyor belts.

According to the present invention, since the thin film being conveyed by the first and second conveyor belts is supplied with tension in the crosswise (transverse) direction of the film, i.e. crossing the conveyance direction, the thin film can be securely sandwiched with uniform force by the first and second conveyor belts, so that the thin film can be securely conveyed.

DETAILED DESCRIPTION OF THE PREFERRED EMBODIMENT

Figure 1:
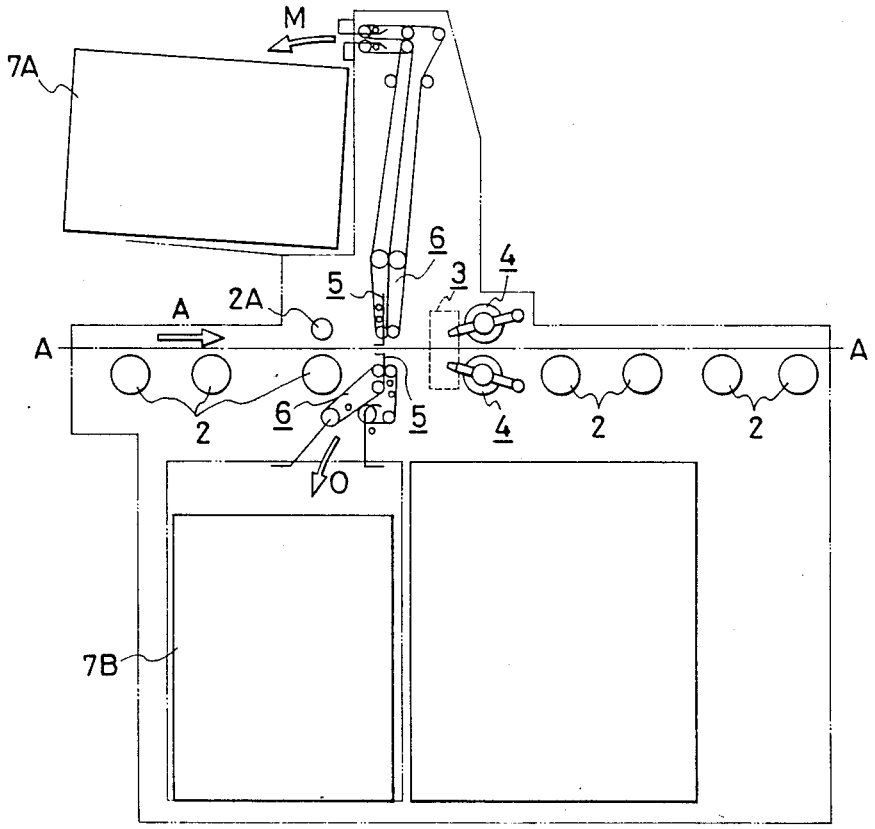
FIG. 1 is a side view showing a schematic construction of an apparatus for peeling a protective film on a board and conveying the peeled film, according to the present invention.

This invention will be described in detail with reference to an apparatus for peeling a protective film from a printed circuit board having a protective film conveyance apparatus to which the technical concept of the present invention is applied.

In the accompanying drawings, like parts are designated by like reference numerals or characters.

FIG. 1 is a schematic side view showing a construction of an apparatus for peeling a protective film on a board for a printed circuit board and delivering the film peeled, according to the present invention.

Figure 2:
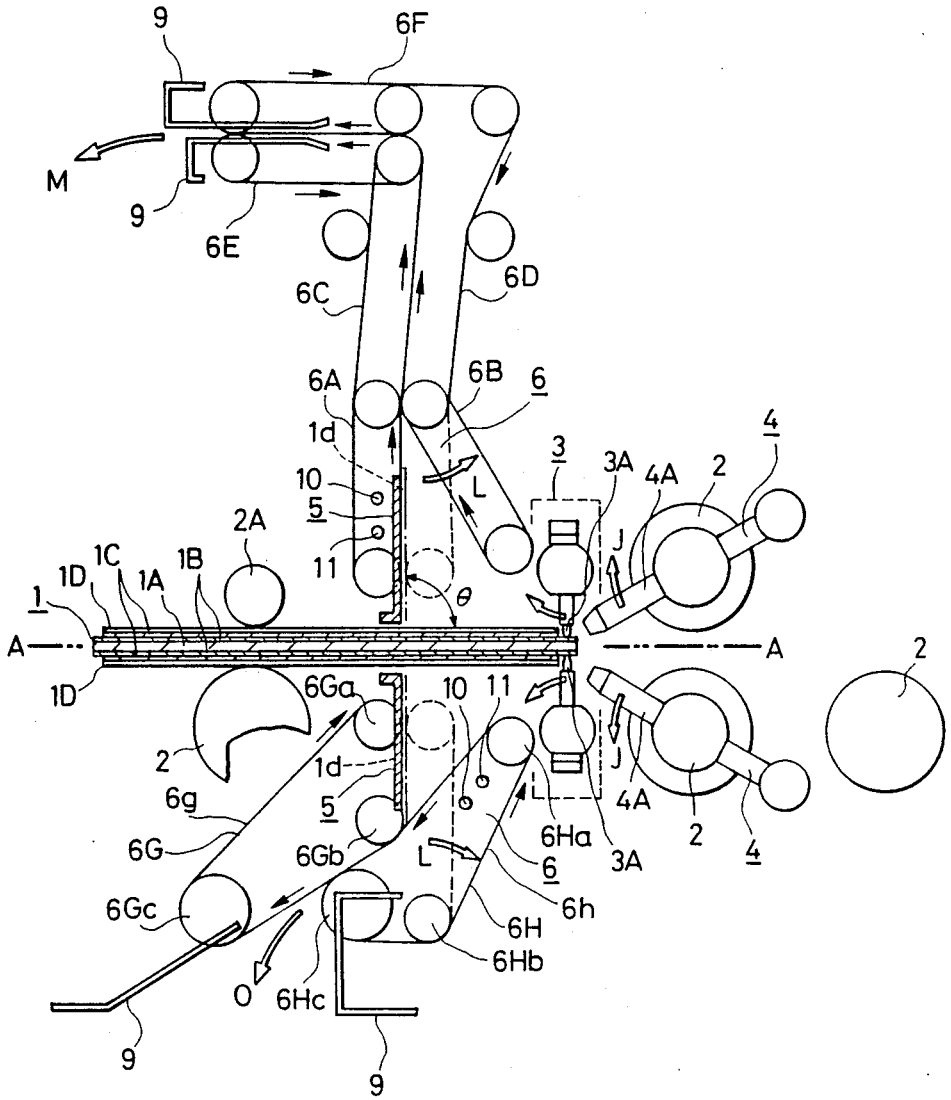
FIG. 2 is an enlarged side view of the principal portion of FIG. 1.

FIG. 2 is an enlarged side view of the principal portion of FIG. 1.

According to the present invention, the mechanism for conveying a board in the film peeling apparatus mainly comprises conveyance driving rollers 2 for conveying a board 1, as shown in FIGS. 1 and 2.

In the above-described conveyance mechanism, a projected press mechanism 3, a fluid injection mechanism 4, a peel angle setting plate (auxiliary peeling plate) 5 and a film delivery mechanism (film conveyance apparatus) 6 are arranged along the conveyance path A—A.

In the board 1, a conductive layer 1B of copper or the like is formed on one or both sides of an insulated substrate 1A, as shown in FIG. 2. A laminate consisting of a photosensitive resin layer 1C and a translucent resin film (or a protective film) 1D is thermally formed on the conductive layer 1B of the board 1 under pressure. The photosensitive resin layer 1C has been exposed to light in a predetermined circuit pattern.

The conveying rollers 2 are so designed as to convey the board 1 in the direction of the arrow A, as shown in FIG. 1.

Figure 3:
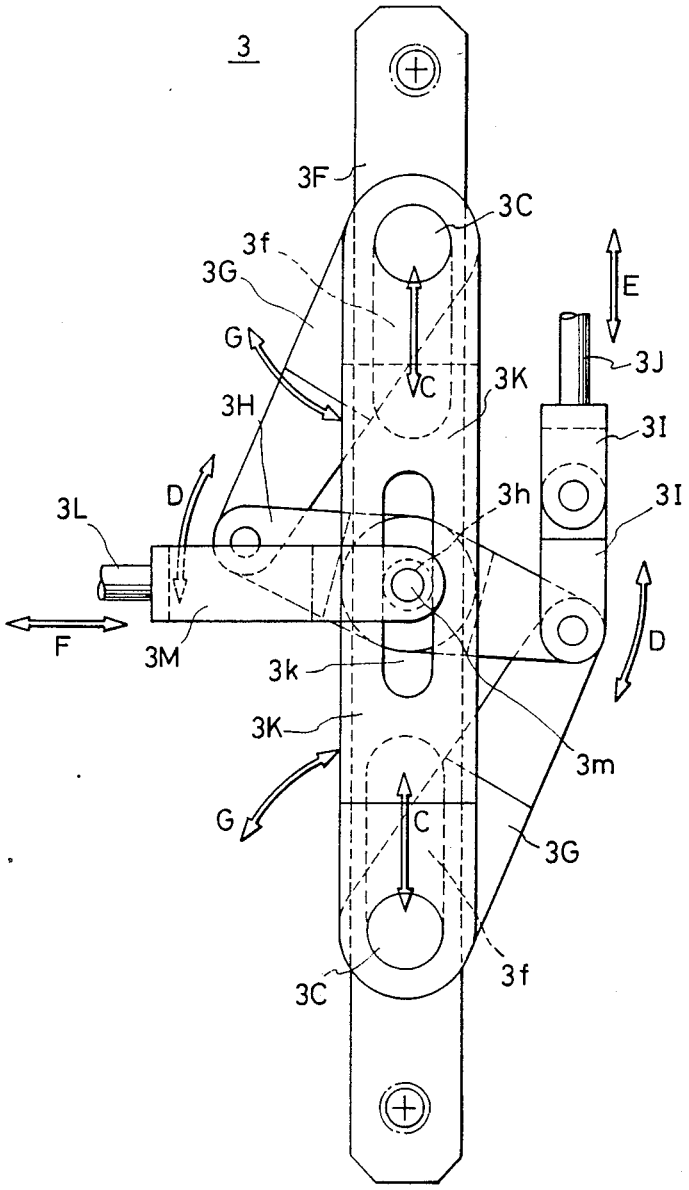
FIG. 3 is a view showing the projected press mechanism of FIGS. 1 and 2.
Figure 5:
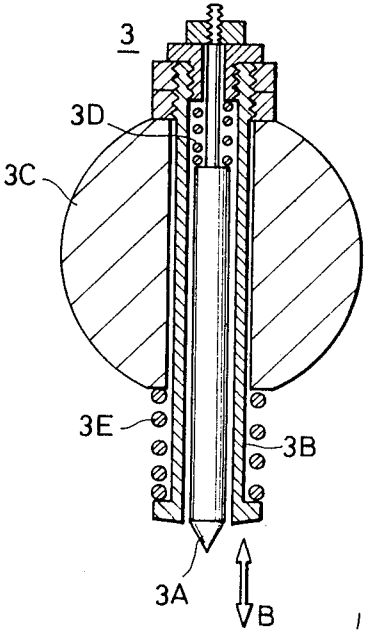
FIG. 5 is a partial sectional view of the projected press member of FIG. 4.
Figure 4:
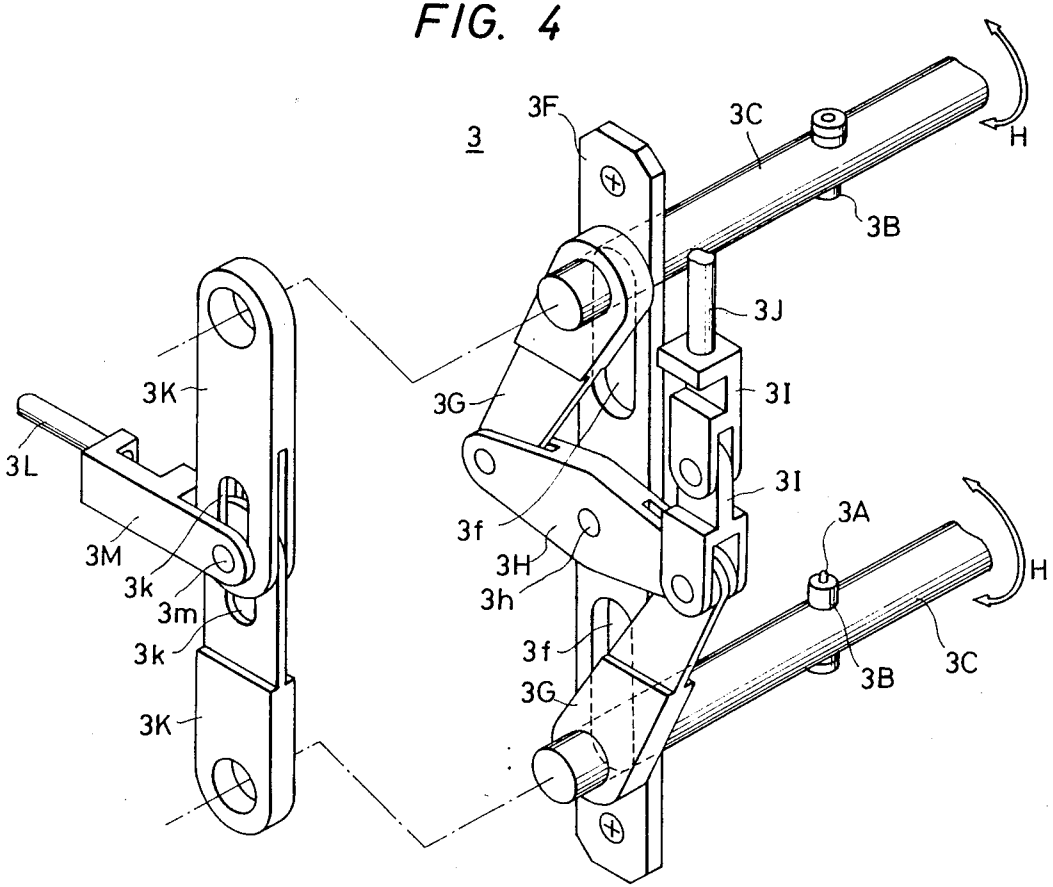
FIG. 4 is an enlarged exploded view of FIG. 3.

The projected press mechanism 3 is constructed as shown in FIGS. 3 to 5.

The projected press mechanism 3 comprises a plurality of projected press members 3A installed on both sides of the board 1. The projected press members 3A are arranged in the direction across the conveyance direction (the crosswise or transverse direction of the printed circuit board 1). The projected press member 3A is needle-shaped as shown in FIG. 5 and formed so that the end of the laminated body including the photosensitive resin layer 1C and the translucent resin film 1D is pressed by the front end of the projected press member 3A. The projected press member 3A is arranged so that the press member is not entered into the interface between the conductive layer 1B and the photosensitive resin layer 1C when the projected press member 3A presses the end of the laminated body. A tip end angle of the projected press member 3A is about 60 degrees. The projected press members 3A arranged opposite to each other are supported by projected press member supporting rotary shafts 3C through holders 3B, respectively. The holder 3B is installed in such a manner as to slide along the through-hole (which is not supplied with a numeral or character) of the projected press member supporting rotary shaft 3C.

The resilient member 3D is installed between the projected press member 3A and the holder 3B. The resilient member 3E having a resiliency which is the same as or different from that of the resilient member 3D is installed between the holder 3B and the projected press member supporting rotary shaft 3C. The resilient members 3D and 3E are installed in the direction of an arrow B, and act on the direction close to the printed circuit board 1. Accordingly, the position of the front end of the projected press member 3A with respect to the projected press member supporting rotary shaft 3C can be changed by applying pressures in the direction of the arrow B.

One end (or both ends) of the projected press member supporting rotary shaft 3C is, as shown in FIGS. 3,4, rotatably coupled to one end of a moving arm member 3G through a guide slit 3*f* made in a guide member 3F. The guide member 3F is fixed to the apparatus body with machine screws and the like (not shown). The guide slit 3*f* is formed in the direction (of an arrow C) approaching to or departing from the board 1 so as to guide the projected press member supporting rotary shaft 3C, i.e., the projected press member 3A in the direction of an arrow C.

The other end of each moving arm member 3G is rotatably secured to one of the opposite ends of a rotary arm member 3H secured rotatably on the rotary shaft 3*h* in the direction of an arrow D. The rotary arm member 3H is capable of moving each moving arm member 3G in the longitudinal direction of an arrow C.

The guide member 3F, the moving arm member 3G and the rotary arm member 3H for guiding the projected press member supporting rotary shaft 3C constitute the link mechanism of the projected press mechanism 3 for causing the projected press members 3A installed on both sides of the printed circuit board 1 to move close to and away from each other, by the movement of the shaft 3J of the driving source for both side use in the direction of an arrow E. The shaft 3J is coupled to one end of the rotary arm member 3H through an arm coupling member 3I. The members constituting the link mechanism each are prepared from material which is relatively resistant to deformation under external force, such as iron, aluminum alloy and rigid plastics. As a driving source, a pneumatic or hydraulic cylinder, or a solenoid can be used. The shaft 3J is not limited to be coupled to one end of the rotary arm member 3H. The shaft 3J may be coupled to one end of the moving arm member 3G through the arm coupling member 3I.

By thus coupling the projected press member 3A to the driving source by means of the link mechanism, the projected press members 3A installed on both sides of the board 1 each may be caused to contact with or depart from the surface of the board 1. The projected press member 3A moves in the direction of the arrow C. In other words, the link mechanism is capable of driving the projected press members 3A on both sides by one driving source (bilateral driving source). Therefore, it is unnecessary to provide individual driving sources for driving the projected press members 3A on each side of the board 1 the board 1.

Material forming the guide member 3F, the moving arm members 3G and the rotary arm member 3H constituting the link mechanism is rigid. The operating range of these parts is defined by the guide slit 3*f* and the rotary shaft 3*h*. Therefore, the projected press members 3A on both sides of the board 1 can be controlled accurately, with the operating amount and operating time of the projected press members 3A on both sides being almost equal to each other.

The link mechanism for coupling the projected press member 3A and the driving source can be made simpler in construction than when it is formed with a rack and pinion or gear mechanism, since the number of parts required is smaller and each part is simpler in configuration.

A projected press member rotating arm member 3K is installed at the end (or both ends) of each projected press member supporting rotary shaft 3C linked with the moving arm member 3G in such a manner that one end of the projected press member rotating arm member 3K is fixed to the end of the projected press member supporting rotary shaft 3C. At the other end of each projected press member rotating arm member 3K, provided is a slit 3*k*. The shaft 3*m* of the arm coupling member 3M connected to the shaft 3L of the driving source use is passed through the slit 3*k*. In other words, the projected press member rotating arm member 3K is coupled to the shaft 3L of the driving source through the coupling arm member 3M. As the bilateral driving source, a driving source similar to what is applied to the above-described link mechanism may be used.

When the shaft 3L moves in the direction of an arrow F, the projected press member rotating arm member 3K rotates in the direction of the arrow G and the projected press member supporting rotary shaft 3C rotates in the direction of an arrow H, so that the projected press member 3A presses the end of the laminated body. In other words, the projected press member rotating arm member 3K and the arm coupling member 3M constitute the projected press member pressing mechanism of the projected press mechanism 3.

The projected press member pressing mechanism thus constructed is capable of operating the projected press members 3A on both sides of the printed circuit board 1 with one driving source and is capable of controlling the operating quantity and time thereof accurately, as in the case of the link mechanism for moving the projected press members 3A toward and away from each other.

Moreover, the projected press member pressing mechanism can simplify the coupling mechanism for coupling the projected press member 3A and the bilateral driving source.

The projected press mechanism 3 thus comprises the projected press members 3A, the link mechanism for causing the projected press member 3A to approach and depart from the board 1, and the projected press member pressing mechanism for pressing the end of the laminated body with the projected press member 3A.

Although the link mechanism or projected press member pressing mechanism and the driving source are installed on one side of the projected press member supporting rotary shaft 3C, they may be installed on both sides according to the present invention.

Referring to FIGS. 1 through 7, the operation of the projected press mechanism 3 will be described briefly.

A thin film end detector (not shown) is used first. As a thin film end detector, touch sensor for electrically detecting the end of a thin film laid on the board 1 or a photosensor for optically detecting the same can be used.

When the end of a thin film stuck onto the board is detected by the thin film end detector, a pinch roller 2A shown in FIGS. 1 and 2 is pressed against the board 1 using a press means (not shown), and the conveyance of the board 1 is temporarily stopped by the pinch roller 2A and a conveyance driving roller 2. At this time, the board is prevented from moving, since material such as rubber having a high coefficient of friction is attached to the outer peripheral surface of the conveyance driving roller 2 opposite to the pinch roller 2A. Therefore, the conveyance of the board 1 is stopped securely, so that the board 1 is fixed.

Figure 6:
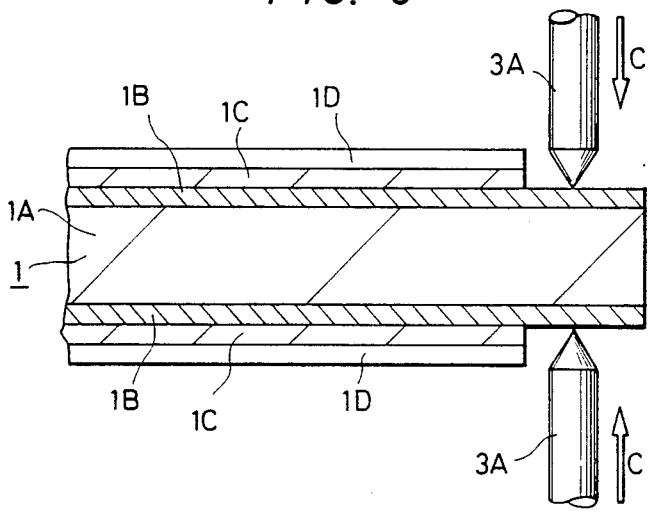
FIGS. 6 and 7 are sectional views of the principal portions of the board of FIG. 2.

The shaft 3J of the driving source coupled to the link mechanism is moved in the direction of an arrow E (upward in FIG. 3). This operation allows the link mechanism constituted by the rotary arm member 3H, the moving arm member 3G and the guide member 3F to operate, so that the projected press member supporting rotary shaft 3C is caused to move in the direction of the arrow C. As a result of which each of the front ends of the projected press members 3A on both sides of the printed circuit board 1 contacts with the surface of the conductive layer 1B at the end of the laminated body as shown in FIG. 6. The tip end of the projected press member 3A is contacted with the surface of the conductive layer 1B with a suitable pressing force such that the resilient member 3D (3E) may have energy.

Figure 7:
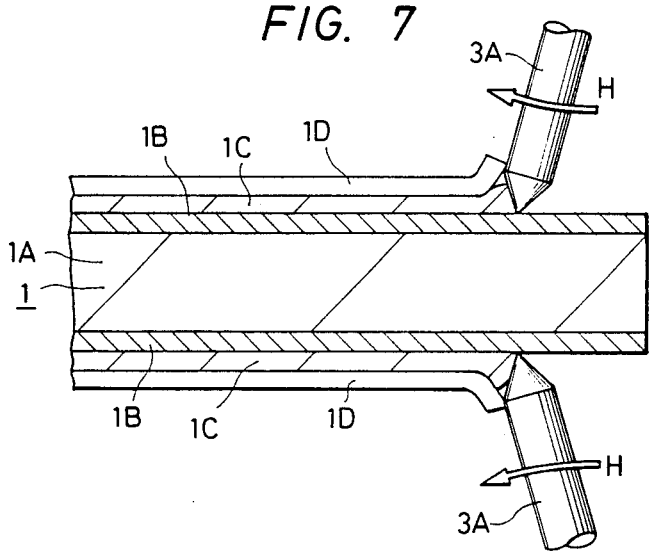

While the projected press member 3A is in contact with the conductive layer 1B, the shaft 3L of the driving source coupled to the projected press member pressing mechanism is moved in the direction indicated by an arrow F (to the left in FIG. 3). This movement of the shaft 3L causes the projected press member pressing mechanism comprising the projected press member rotating arm member 3K and the arm coupling member 3M to operate, so that the projected press member supporting rotary shaft 3C is rotated in the direction of the arrow H. By the rotation of the projected press member supporting rotary shaft 3C, the front ends of the projected press members 3A on both sides of the board 1 press against the end of the laminated body, as shown in FIG. 7.

The end of the laminated body having the photosensitive resin layer 1C and the translucent resin film 1D is pressed by the projected press members 3A, so that a part of the translucent resin film 1D is peeled off from the photosensitive resin layer 1C, and a gap is produced at the interface between the film 1D and the layer 1C, as will be described hereinafter. The photosensitive resin layer 1C is prepared from material softer than that for the translucent resin film 1D. Therefore, the film 1C is apt to be subjected to plastic deformation by the pressure applied by the projected press member 3A than the layer 1D. Therefore, first, only the film 1C is deformed. The adhesion of the layer 1D to the film 1C reduces, before the layer 1D is deformed. Therefore, a gap is produced between the film 1C and the layer 1D.

Moreover, the end of the translucent resin film 1D can be peeled off by the needle-shaped projected press member 3A which is simple in configuration.

Since the projected press member 3A is installed in the conveyance path of the board, the end of the translucent resin film 1D can automatically be peeled off.

A plurality of projected press members 3A are provided in the direction crossing (crosswise direction) the conveyance direction of the printed circuit board 1 according to this embodiment, in order that the film of the laminated body which is heat bonded distortedly on the printed circuit board 1 can also be peeled off surely. However, the present invention is not limited to the above structure. In other words, the projected press mechanism 3 may be so arranged as to have only one projected press member 3A on the respective sides of the board 1, if the end portion of the photosensitive resin layer 1C and the translucent resin film 1D is pressed so that the film 1D can be surely peeled off.

Although the projected press members 3A are arranged in the direction (crosswise direction) crossing the conveyance direction of the board 1 according to this embodiment, the projected press members 3A may be arranged at the end portions or portions close to the corner of the laminated body, in the same direction as the conveyance direction of the board 1. In this case, the nozzle 4A of the fluid injection mechanism. 4 is set close to the projected press member 3A.

The projected press member pressing mechanism of the projected press mechanism 3 according to this embodiment of the present invention is arranged in the form of the link mechanism. However, the pressing mechanism according to the present invention may be so constructed that the board 1 is carried slightly by the rotation of the conveyance driving roller 2 (or the pinch roller 2A) with the projected press member 3A being in contact with the surface of the board 1 at the end of the laminated body, and the end of the laminated body being pressed by the projected press member 3A. That is, the pressing mechanism may be constructed by a conveyance mechanism.

Moreover, the cross section of the rotary shaft 3C in the direction across the axis of the shaft according to the present invention may be square, in order to increase the accuracy of processing the through-hole into which the holder 3B is fitted and in order to facilitate the processing.

As shown in FIGS. 1 and 2, the fluid injection mechanism 4 may be so arranged as to send a jet of pressurized fluid such as air or inactive gas or liquid such as water out of the nozzle 4A directly to the gap between the photosensitive resin layer 1C and the peeled translucent resin film 1D. The fluid injection mechanism is also positioned close to the projected press mechanism 3 so that the fluid can instantly be sent to the gap. The fluid injection mechanism 4 is provided with the nozzle 4A with its set angle being variable in the direction of an arrow J. As a result, the fluid injection mechanism 4 sets its nozzle 4A close to the gap between the layers 1C and 1D at the time of injecting the fluid, and after the fluid has been injected, the fluid injection mechanism 4 moves the nozzle 4A back to the position where the nozzle is prevented from touching the board 1.

By the fluid injection mechanism 4, fluid is blown into the gap between the photosensitive resin layer 1C and the translucent resin film 1D produced under the pressure of the projected press member 3A, as a result of which it is ensured to peel the translucent resin film 1D off the photosensitive resin layer 1C instantly.

Figure 8:
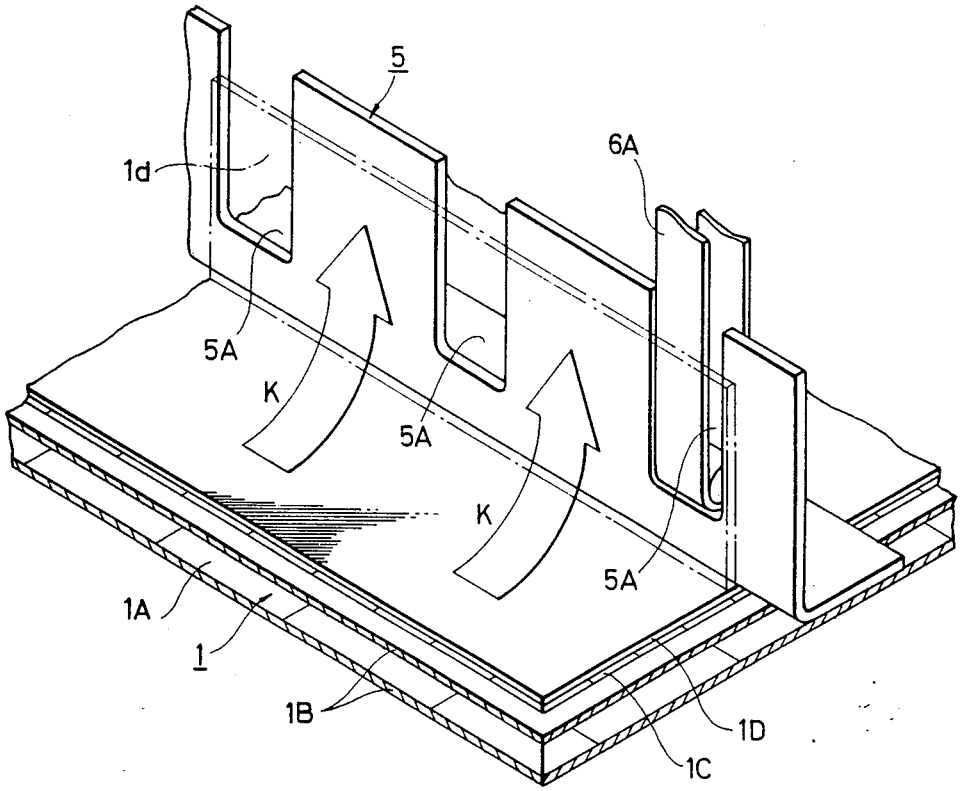
FIG. 8 is a perspective view of the principal portions of the peel angle setting plate of FIGS. 1 and 2.

As shown in FIGS. 2 and 8, the front end 1*d* of the translucent resin film with respect to the conveyance direction thereof peeled off by the fluid injection mechanism 4 is stuck to the peel angle setting plate (auxiliary peeling plate) 5 by the fluid pressure, and the peel angle $\theta$ for the peel position and direction is set. The translucent resin film 1*d* is shown by one-dot-and-dash line of FIGS. 2 and 8. The peel angle $\theta$ is the angle of the translucent resin film 1*d* pulled up with respect to the board 1 or the translucent resin film 1D stuck onto the board 1. The peel angle $\theta$ is set to about 90 degrees.

The peel angle setting plate 5 is installed such that the front end of the peel angle setting plate 5 (peel position) on the peeling side is apart from the translucent resin film 1D stuck to the printed circuit board 1 and such that the setting plate may not brush with the resin film 1D to prevent the photosensitive resin layer 1C from being damaged or broken down. Furthermore, the peel angle setting plate 5 is movably arranged so that the end of the peel angle setting plate 5 sticks tightly to the translucent resin film 1D during the time the fluid is being sprayed, for preventing reduction of the peel effect, since the reduction of the peel effect is caused if the fluid is blown through between the end of the peel angle setting plate 5 and the board. Moreover, the front end of the peel angle setting plate 5 is in a circular arc form with its curvature radius being small, that is, its curvature radius being less than 3 mm.

Moreover, the peel angle setting plate 5 has its front end located closer to the printed circuit board 1 than the thin film delivery mechanism 6. The peel angle setting plate 5 extends in the peel direction (film delivery direction) with a predetermined length. The peel angle setting plate 5 extends in a crosswise direction of the peeled film crossing the film peeling direction with its length being enough to cover the width of the conveyance path of the printed circuit board 1 or the fluid injection width in the peel direction. In other words, the peel angle setting plate 5, as the direction of the fluid flow is shown by an arrow K in FIG. 8, is capable of increasing the peeling effects, by preventing the fluid from being blown to the rear side of the peel angle setting plate 5 and is capable of increasing the adhesion of the peeled translucent resin film 1*d* to the peel angle setting plate 5.

The peel angle setting plate 5 is fixed to the apparatus body at a predetermined position apart from the nozzle 4A in the fluid flowing direction.

The peel angle setting plate 5 is able to stabilize the peel position and add uniform peeling force to the translucent resin film 1D. Accordingly, the peel angle setting plate 5 prevents the peel position from shifting when the translucent resin film 1D is being peeled off and prevents peel stress from distorting and the photosensitive resin layer 1C from being damaged or broken.

The $\theta$ of the peel angle setting plate 5 with respect to the translucent resin film 1D may be set variably within the range of an obtuse to a right angle, according to changes in conditions, such as a change of material for the translucent resin film 1D, a change of the fluid pressure in the fluid spray mechanism 4, etc. Moreover, the peel angle setting plate 5 may be so arranged as to be movable, in correspondence to the thickness of the printed circuit board 1, the photosensitive resin layers 1C or the translucent resin films 1C. The setting plate 5 may be moved or transferred by an air or hydraulic cylinder.

Figure 9:
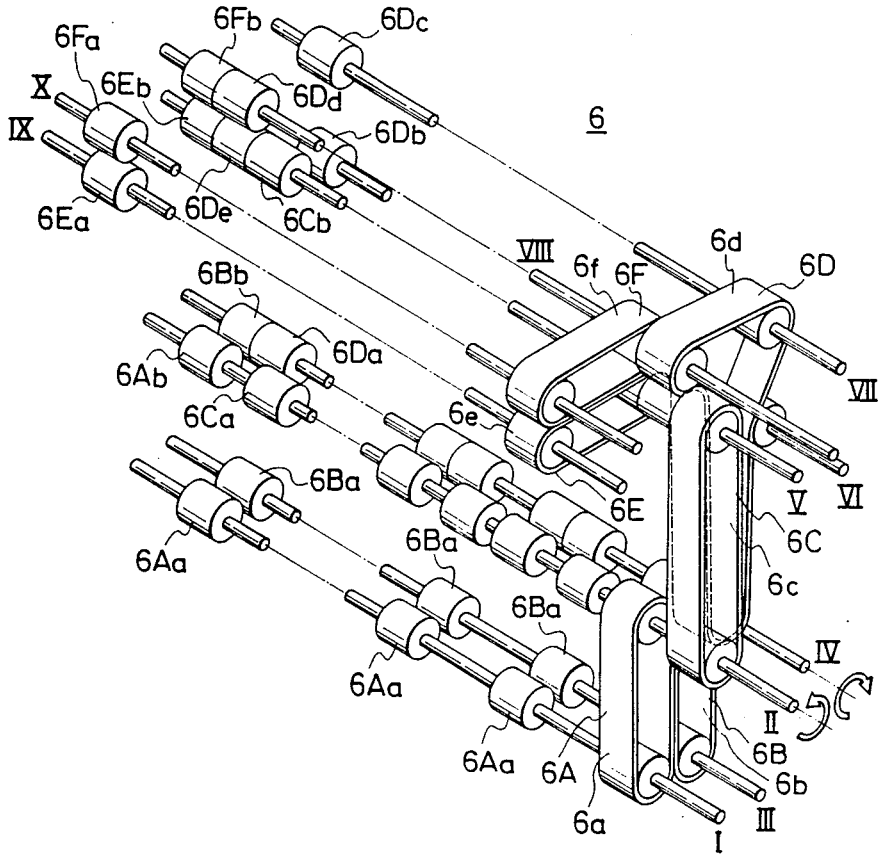
FIG. 9 is an expanded exploded perspective view of the film conveyance mechanism of FIGS. 1 and 2.

The translucent resin film 1*d* stuck to the setting plate 5 by the fluid injection mechanism 4 is, as shown in FIGS. 1, 2 and 9, carried out by the film carrying out mechanism (thin film conveyance mechanism) 6 while the thin film is being peeled off.

The thin film conveyance mechanism 6 comprises an upper conveyor belt mechanism and a lower conveyor belt mechanism installed on both sides of the printed circuit board 1, respectively.

The upper conveyor belt mechanism consists of, as shown in FIG. 9 in detail, fixed conveyor belts 6A, 6C, 6D, 6E, 6F and moving conveyor belts 6B.

The fixed conveyor belt 6A consists of a roller 6A*a* supported by a driven shaft I, a roller 6A*b* supported by a driving shaft II and a belt 6*a* wound on the rollers 6A*a*, 6A*b*.

The moving conveyor belt 6B consists of a roller 6B*a* supported by a driven shaft III, a roller 6B*b* supported by a driving shaft IV and a belt 6*b* wound on the rollers 6B*a*, 6B*b*. The moving conveyor belt 6B is rotated on the driving shaft IV in the direction of an arrow L as shown in FIG. 2. The moving conveyor belt 6B facilitates the adhesion of the peeled translucent resin film 1*d* to the peel angle setting plate 5 and is capable of carrying the translucent resin film 1*d* by sandwiching it between the moving conveyor belt 6B and the fixed conveyor belt 6A. The operation of sandwiching the translucent resin film 1*d* between the fixed and moving conveyor belts 6A, 6B is conducted through a cut 5A provided in the setting plate 5, as shown in FIG. 8. The cut 5A is designed to help the conveyor belts 6A, 6B sandwich the translucent resin film 1*d* whose peel position and angle have been set by the setting plate 5 when both the belts 6A, 6B reach the translucent resin film 1*d*. As a result, it is ensured that the translucent resin film 1*d* is sandwiched between the fixed and moving conveyor belts 6A, 6B.

The fixed conveyor belt 6C consists of a roller 6C*a* supported by the driving shaft II, a roller 6C*b* supported by a driven shaft V and a belt 6*c* wound on rollers 6C*a*, 6C*b*.

The fixed conveyor belt 6D consists of a roller 6D*a* supported by the driven shaft IV, a roller 6D*b* supported by the driven shaft VI, a roller 6D*c* supported by a driven shaft VII, a roller 6D*d* supported by a driven shaft VIII, a roller 6D*c* supported by the driven shaft V and a belt 6*d* wound on rollers 6D*a* to 6D*e*.

Figure 10:
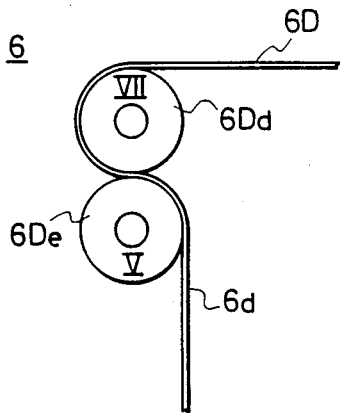
FIGS. 10 and 11 are sectional views of the principal portions of the film conveyance mechanism of FIG. 9.

The fixed conveyor belts 6C and 6D are so arranged as to further carry away the translucent resin film 1*d* carried away by the fixed and moving conveyor belts 6A and 6B. The roller 6D*e* of the fixed conveyor belt 6D is intended to comply with the change of the conveyance direction at a large angle when the translucent resin film 1*d* is carried out from the fixed conveyor belts 6C, 6D to the fixed conveyor belts 6E, 6F, as shown in FIG. 10. In other words, the curvature radii of the belts 6*c* and 6*d*, on their surfaces contacting with the translucent resin film 1*d* at the position where the conveyance direction is changed are made equal to each other by the roller 6D*e*. Accordingly, the translucent resin film 1*d* is prevented from producing wrinkles and trouble such as a jam during conveyance.

Figure 11:
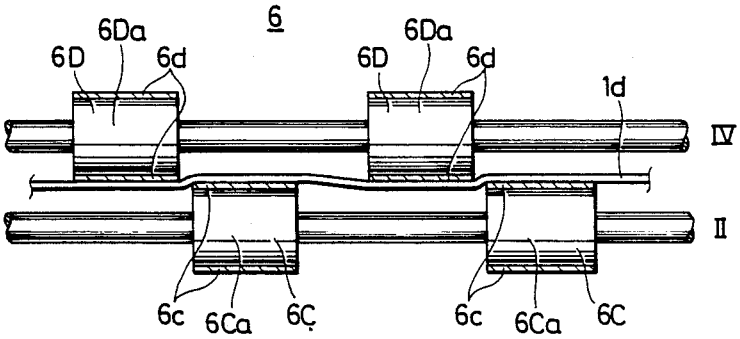

As shown in FIG. 11 (a partial sectional view), a plurality of fixed conveyor belts 6C (or 6D) brought in contact with one side of the translucent resin film 1*d* are installed at fixed intervals in a transverse direction with respect to the conveyance direction of the translucent resin film 1*d*. The fixed conveyor belts 6D (or 6C) brought in contact with the other side of the translucent resin film 1*d* are installed in between the plurality of the fixed conveyor belts 6C (or 6D). In other words, the fixed conveyor belts 6C, 6D are arranged in a staggered manner in the crosswise (transverse) direction of the translucent resin film 1*d* so that surfaces of the belts 6*c*, 6*d* (the contacting faces with the translucent resin film 1*d*) are in a single plane, or otherwise the belts 6C, 6D bite into each other such that a plane formed by the surfaces of the belts 6*c* crosses the belts 6D and a plane formed by the surfaces of the belts 6*d* crosses the belts 6C.

Since the fixed conveyor belts 6C, 6D are thus arranged in a staggered manner, the translucent resin film 1*d* being carried out is supplied with tension in the crosswise direction thereof, so that the translucent resin film 1*d* can be sandwiched securely and uniformly between the fixed conveyor belts 6C, 6D.

Moreover, the translucent resin film 1*d* sandwiched in between the fixed conveyor belts 6C, 6D is carried in such a form as to wrap the surfaces and sides of the belts 6*c*, 6*d*, respectively. In consequence, the rollers 6C*a*, 6C*b*, 6D*a* to 6D*e* are not allowed to shift from the belts 6*c* and 6*d* in the axial direction of the rollers, respectively. The sandwiching force applied to the translucent resin film 1*d* during conveyance is thus made uniform, so that wrinkles and thus jamming are prevented from occurring. Since the thin film conveyance mechanism according to the present invention has a container 7A for containing the peeled upper translucent resin films conveyed by the upper conveyance belt mechanism and discharged, as will be described later, and the conveyance path of the upper conveyance belt mechanism is longer than the lower conveyance belt mechanism, it is effective to form the fixed conveyor belts 6C, 6D in such a manner as described above.

The fixed conveyor belt 6E consists of a roller 6E*a* supported by a driven shaft IX, a roller 6E*b* supported by the driven shaft V and a belt 6*e* wound on the rollers 6E*a*, 6E*b*.

The fixed conveyor belt 6F consists of a roller 6F*a* supported by a driven shaft X, a roller 6F*b* supported by the driven shaft VIII and a belt 6*f* wound by the rollers 6F*a*, 6F*b*.

As shown in FIGS. 1, 2, the fixed conveyor belts 6E and 6F are so arranged as to discharge the translucent resin film 1*d* carried by the fixed conveyor belts 6C and 6D from the apparatus body in the direction of an arrow M. The translucent resin film 1*d* discharged from the apparatus body is contained in the container 7A for containing the peeled upper translucent resin films discharged, as shown in FIG. 1. The container 7A is detachably mounted on the apparatus body, in its upper portion.

Figure 9A:
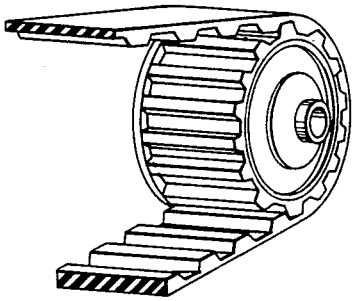
FIG. 9A shows a toothed pulley and a toothed belt used in the present invention.

As the driving and driven shafts, toothed pulleys as shown in FIG. 9A are used in the present invention. As the conveyor belts, toothed belts having teeth for being engaged with the teeth of the toothed pulleys as shown in FIG. 9A are used.

The lower conveyor belt mechanism comprises a fixed conveyor belt 6G and a moving conveyor belt 6H as shown in FIG. 2.

The fixed conveyor belt 6G consists of rollers 6G*a*, 6G*c* supported by different driven shafts (not shown), a roller 6G*b* supported by a driven shaft (not shown) and a belt 6*g* wound on the rollers 6G*a* to 6G*c*.

The moving conveyor belt 6H consists of rollers 6H*a* and 6H*c* supported by different driven shafts (not shown), a roller 6H*b* supported by a driven shaft (not shown) and a belt 6*h* wound on the rollers 6H*a* to 6H*c*.

The fixed conveyor belts 6G and the moving conveyor belt 6H carry a translucent resin film 1*d* peeled from the another side of the board, with peeling the film 1*d* whose peel position and angle are set by the setting plate 5 as in the case of the above-described upper conveyor belt mechanism. The conveyor belts 6G and 6H discharge the translucent resin film 1*d* from the apparatus body in the direction of an arrow O. The translucent resin film 1*d* discharged from the apparatus body is contained in a container 7B for containing the discharged lower translucent resin films as shown in FIG. 1. The container 7B is detachably mounted on the apparatus body. Moreover, the container 7A for containing the discharged upper translucent resin films is installed above the container 7B so that area occupied by the containers 7A and 7B is reduced to thereby make the apparatus body compact.

Moreover, a roll-in preventing member 9 is installed close to the conveyance path on the discharge side, between the respective two conveyor belts 6E and 6E (6F and 6F, 6G and 6G and 6H and 6H) disposed adjacent to each other in the transverse direction of the film 1*d* . Accordingly, the translucent resin film 1*d* is prevented from being wound on the fixed conveyor belts 6E, 6F, 6G or moving conveyor belt 6H.

As shown in FIG. 2, static eliminators 10 and ion dispersion devices 11 are installed close to the fixed conveyor belt 6A and the moving conveyor belt 6H, respectively. The static eliminator 10 is used to discharge ions in order that the static electrification of the translucent resin film 1*d* to be occurred while the film 1*d* is peeled off or carried can be reduced. The ion dispersion device 11 disperses the ions discharged by the static eliminator 10, in order to efficiently reduce the static electrification of the film 1*d*. The device 11 disperses ions using pressurized fluid such as air, for example.

The projected press member 3A may be wedge-shaped or plate-shaped instead of needle-shaped according to the present invention.

The present invention is applicable to a thin film conveyance apparatus for a thin film peeling apparatus equipped with a thin film raising mechanism for raising up the end of a translucent resin film 1D with a brush having a plurality of needles on the circumference of a rotary body.

The present invention is also applicable to a thin film delivery apparatus for a thin film peeling apparatus equipped with a thin film raising mechanism for pressing the end of a translucent resin film 1D with a knurl roll and raising that portion.

The present invention is further applicable to a thin film delivery apparatus for a thin film peeling apparatus for peeling a translucent resin film 1*d* by raising an end portion of the film by the projected press mechanism 3 and pressing the end portion with an adhesion member to be stuck thereto.

The present invention is further applicable to a thin film conveyance apparatus for an apparatus for peeling a protective film stuck to a decorative laminated sheet as building material.

Although the invention is described in its preferred from with a certain degree of particularity, it is believed obvious that various changes and modifications may be made in the invention without departing from the spirit and scope thereof.

As set forth above, the present invention has the following effects:

According to the present invention, a film conveying apparatus for conveying a film by conveyor belts, comprises a plurality of first conveyor belts for conveying the film by contacting with one side of the thin film and a second conveyor belt for conveying the film by contacting with the other side of the film, the plural first conveyor belts being arranged at fixed intervals in a crosswise direction of the film transverse to the conveyance direction, the second conveyor belt being disposed between the first conveyor belts. Therefore, the thin film being conveyed by the first and second conveyor belts is supplied with tension in the crosswise direction of the film. As a result, the film can be securely sandwiched with uniform force by the first and second conveyor belts, so that the film can be securely conveyed.

Furthermore, the conveyor belts are prevented from shifting from the rollers in a roller axial direction by the reaction force to the tension force applied to the film.

Furthermore, according to the present invention, instead of rollers, conveyor belts are used for conveying thin films. Therefore, maintenance for securely conveying the film can be facilitated. Furthermore, wrinkles can be prevented from occurring in the film being conveyed.

I claim:

1. In a device for removing a protective film from a board for forming a circuit thereon, the device including means for transporting the board along a path, and means for peeling the film from the board, a film conveying apparatus for conveying the peeled film away from the board and path, wherein the film conveying apparatus comprises:

a first conveyance means for conveying a film in a conveyance direction by contacting one side of the film, a plurality of said first conveyance means being disposed at predetermined intervals in a direction transverse to the conveyance direction, said first conveyance means comprising a plurality of conveyor rollers and a plurality of conveyor belts wound on corresponding ones of said conveyor rollers; and a second conveyance means for conveying the film by contacting the other side of the film, said second conveyance means comprising a plurality of conveyor rollers and a plurality of conveyor belts wound on corresponding ones of the conveyor rollers, and said conveyor rollers and corresponding ones of said conveyor belts of said second conveyance means being disposed between adjacent ones of said plurality of conveyor rollers and corresponding conveyor belts of said first conveyance means, wherein said device further comprises a plate disposed proximate to a position on the path at which the film is peeled by said means for peeling, said means for peeling including means for jetting fluid against the film to press it against one side of said plate and a third conveyance means for conveying the film which is pressed against said plate away from the plate, said third conveyance means comprising first conveyor belts extending in a direction substantially parallel to said plate and disposed on another side of said plate opposite the one side, and second conveyor belts disposed on the one side of the plate and movable between first and second positions, said second conveyor belts in said first position being disposed away from the first conveyor belts, the film and said plate, and in said second position said second conveyor belts extending in a direction substantially parallel to said plate and contacting the film, said plate being formed so as to allow said first conveyor belts to contact the film between said second conveyor belts in the second position and said plate, whereby said first and second conveyor belts are adapted for transporting the film therebetween away from said plate.

2. A device as claimed in claim 1, wherein said conveyor belts of said first conveyance means have respective first surfaces which lie in a first plane for contacting the one side of the film, and said conveyor belts of said second conveyance means have respective second surfaces which lie in a second plane for contacting the other side of the film, said first plane crossing through said conveyor rollers of said second conveyance means and said second plane crossing through said conveyor rollers of said first conveyance means.

3. A device as claimed in claim 1, wherein said conveyor belts of said first conveyance means have respective first surfaces which lie in a first plane for contacting the one side of the film being conveyed and said conveyor belts of said second conveyance means have respective second surfaces which lie in a second plane for contacting the other side of the film, said first and second planes being substantially coincident.

4. A device as claimed in claim 1, wherein each of said conveyor rollers has a toothed surface, and each of said conveyor belts has a toothed surface at its side which does not contact the film being conveyed, said toothed surface of said conveyor belt being engaged with said toothed surface of said conveyor roller.

5. A device as claimed in claim 4, further comprising means for changing the conveyance direction comprising curvature equating means for making a radius of curvature of respective first surfaces of said conveyor belts of said first conveyance means and a radius of curvature of respective second surfaces of said conveyor belts of said second conveyance means equal to each other.

6. A device as claimed in claim 5, wherein said curvature equating means comprising conveyor rollers disposed between adjacent ones of said conveyor rollers of said first conveyance means, said conveyor rollers contacting said conveyor belts of said second conveyance means to make the radius of curvature of said conveyor belts of said second conveyance means equal to that of said conveyor belts of said first conveyance means.

7. A device as claimed in claim 1, wherein said third conveyance means further comprises a pair of first conveyor rollers on which each of said first conveyor belts is wound and a pair of second conveyor rollers on which each of said second conveyor belts is wound, and wherein ones of said first and second conveyor rollers are disposed downstream of other ones of said first and second conveyor rollers and are fixed to driving shafts, and the other ones of said first and second conveyor rollers are fixed to driven shafts to thereby prevent said first and second conveyor belts contacting the film from wrinkling it.

8. In a device for removing a protective film from a board for forming a circuit thereon, the device including means for transporting the board along a path, and means for peeling the film from the board, a film conveying apparatus for conveying the peeled film away from the board and path, wherein the film conveying apparatus comprises:

a first conveyance means for conveying a film in a conveyance direction by contacting one side of the film, a plurality of said first conveyance means being disposed at predetermined intervals in a direction transverse to the conveyance direction, said first conveyance means comprising a plurality of conveyor rollers and a plurality of conveyor belts wound on corresponding ones of said conveyor rollers; and a second conveyance means for conveying the film by contacting the other side of the film, said second conveyance means comprising a plurality of conveyor rollers and a plurality of conveyor belts wound on corresponding ones of the conveyor rollers, and said conveyor rollers and corresponding ones of said conveyor belts of said second conveyance means being disposed between adjacent ones of said plurality of conveyor rollers and corresponding conveyor belts of said first conveyance means, said device further comprising third conveyance means for conveying a film in a conveyance direction, said third conveyance means comprising a pair of first conveyor rollers, a first conveyor belt wound on said first conveyor rollers, a pair of second conveyor rollers and a second conveyor belt wound on said second conveyor rollers, said first and second conveyor belts extending in an initial direction in which the film is to be conveyed, said first and second conveyor belts contacting the film therebetween to convey the film in the initial direction, wherein ones of said first and second conveyor rollers are disposed downstream of others of said first and second conveyor rollers with respect to the initial direction and are fixed to driving shafts, and said others of said first and second conveyor rollers are fixed to driven shafts, to thereby prevent said first and second conveyor belts contacting the film from wrinkling it.

* * * * *